United States Patent [19]

Ozawa et al.

[11] Patent Number: 4,937,627

[45] Date of Patent: Jun. 26, 1990

[54] IMAGE FORMING APPARATUS HAVING TONER REPLENISHING DEVICE INTERCHANGEABLE WITH A DEVELOPING UNIT

[75] Inventors: Hiroshi Ozawa; Masashi Sakamoto; Hidekazu Nakagami, all of Osaka, Japan

[73] Assignee: Minolta Camera Kabushiki Kaisha, Osaka, Japan

[21] Appl. No.: 296,433

[22] Filed: Jan. 12, 1989

[30] Foreign Application Priority Data

Jan. 13, 1988 [JP] Japan ..... 63-6423
Jan. 13, 1988 [JP] Japan ..... 63-6424

[51] Int. Cl.[5] ..... G03G 15/08

[52] U.S. Cl. ..... 355/260; 355/245; 355/326; 118/645; 118/653; 222/DIG. 1

[58] Field of Search ..... 355/260, 245, 326, 327, 355/328; 118/645, 653; 222/325, DIG. 1

[56] References Cited

U.S. PATENT DOCUMENTS

| | | | |
|---|---|---|---|
| 4,460,267 | 7/1984 | Ogawa | 355/260 X |
| 4,625,895 | 12/1986 | Tsukano | 222/325 X |
| 4,641,945 | 2/1987 | Ikesue et al. | 222/325 X |
| 4,650,097 | 3/1987 | Hagihara et al. | 222/DIG. 1 |
| 4,720,730 | 1/1988 | Ito | 355/4 |
| 4,744,493 | 5/1988 | Ikesue et al. | 222/325 X |
| 4,835,566 | 5/1989 | Oka et al. | 355/219 |

*Primary Examiner*—R. L. Moses
*Attorney, Agent, or Firm*—Willian Brinks Olds Hofer Gilson & Lione

[57] ABSTRACT

An image forming apparatus provided with a toner replenishing device attachable to a position of any one of a plurality of developing units. The toner replenishing device replenishes toner to another developing unit through the space of a developing unit to which the toner replenishing device is interchangeably attached.

14 Claims, 10 Drawing Sheets

IMAGE FORMING APPARATUS HAVING TONER REPLENISHING DEVICE INTERCHANGEABLE WITH A DEVELOPING UNIT

BACKGROUND OF THE INVENTION

1. Technical Field of the Invention

The present invention relates to an image forming apparatus for electrophotographically forming images such as copying machines, laser beam printers and the like, and more particularly to an image forming apparatus having a plurality of developing units.

2. Brief Description of Related Art

An image forming apparatus as mentioned above, has recently been designed to produce an image having different colors partially or an image consisting of various colors by providing a plurality of developing units to be interchangeably used in a round of image forming operations or by using a plurality of developing units interchangeably each time an image is formed.

However, such image forming apparatus is not provided with sufficient extra space since various equipments are installed inside the apparatus for the image forming operation, sheet transport, image fixing process, etc. Accordingly, the ability to equip a plurality of developing units around a photoconductor is limited. Especially for copying machines intended to be used for personal use, it has been is attempted to provide developing units of smaller size rather than enlarging the size of the body of the apparatus thereby necessitating a toner replenishing device that is also smaller in its toner accommodating capacity.

Among a plurality of developing units, a developing unit which accommodates black toner is used more frequently than the other developing units. Under such circumstance, if the capacity of a toner replenishing device becomes smaller, the toner accommodated therein is consumed very quickly, and therefore, frequent toner replenishment or frequent exchange of the toner replenishing device becomes inconveniently necessary for users.

SUMMARY OF THE INVENTION

The main object of the present invention is to provide an image forming apparatus capable of solving the problems described above by providing an interchangeable toner replenishing device with a plurality of developing units. The interchangeable toner replenishing device is mounted in place of a developing unit which is not used frequently and replenishes toner to a developing unit which is used frequently.

Another object of the present invention is to provide an image forming apparatus capable of replenishing toner easily and securely by positioning a toner replenishing device in place of a developing unit above a developing unit to be replenished.

Still another object of the present invention is to provide an image forming apparatus capable of actuating a toner replenishing device properly by use of a common driving means with a developing unit which is to be removed without causing the structure of the image forming apparatus to become complicated.

A further object of the present invention is to provide an image forming apparatus which is arranged to precedently use a replaced toner replenishing device to a toner replenishing hopper exclusively attached to a developing unit so that the consumption of toner accommodated in the hopper exclusively attached to the developing unit can be restrained as much as possible.

A still further object of the present invention is to provide a toner replenishing device capable of replenishing toner to other developing units by effectively making use of a space of one of a plurality of developing units being interchangeably used.

Still another object of the present invention is to provide an advantageous toner replenishing device interchangeably usable as a replacement of a developing unit.

The other objects and features of the present invention will become more apparent from the following description taken in conjunction with the accompanying drawings.

FIGS. $11_{-1}$ through $11_{-3}$ are control flow charts for both black and color copying operations.

DESCRIPTION OF THE PREFERRED EMBODIMENT

An embodiment of the present invention will now be decribed below with reference to the accompanying drawings.

The drawings illustrate a case wherein the present invention is applied to a small size electrophotographic copying machine.

Figure 1:
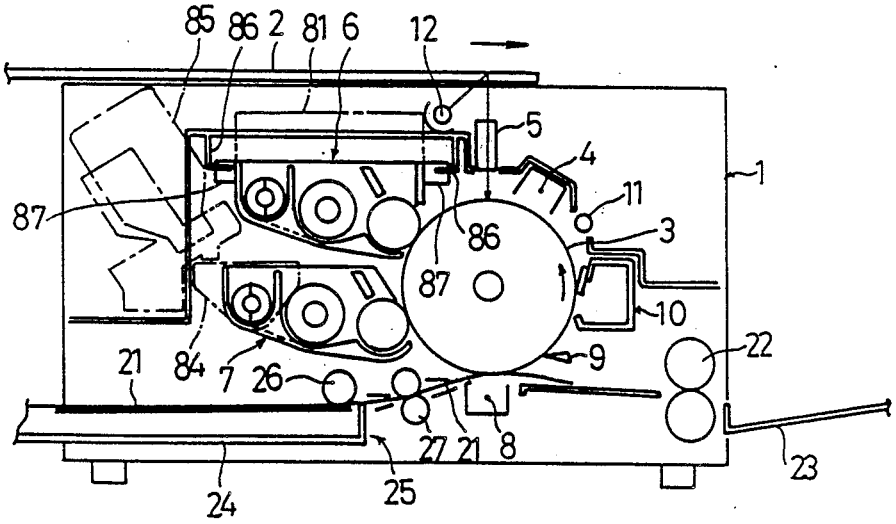
FIG. 1 is a cross-sectional view illustrating an embodiment of the present invention which is applied to an electrophotographic copying machine wherein a color developing unit is being used under ordinary state.

The copying machine is an original scanning type having a movable original table 2 on the body 1 of the machine as shown in FIG. 1. Inside the body 1 of the machine, a photoconductive drum 3 is disposed approximately at the center.

Around the photoconductive drum 3, a charger 4, light converging lens arrays 5 for projecting and exposing an original image on the original table 2 onto the photoconductive drum 3, a color developing unit 6, a black developing unit 7, a transfer charger 8, a separation claw 9. a cleaning device 10 and an eraser lamp 11 are sequentially disposed in the direction of rotation of the photoconductive drum 3. The reference numeral 12 designates a lamp which illuminates an original.

The surface of the photoconductive drum 3 is uniformly charged with the charger 4. Onto the charged surface, an image being moved by the original table 2 is successively slit exposed through the lens array 5 from its leading end to the rear end to form an electrostatic latent image corresponding to the original image. The electrostatic latent image is then visualized by development with both or either one of the color developing unit 6 or the black developing unit 7, and the visualized toner image is transferred by the transfer charger 8 onto a transfer sheet 21 simultaneously transported thus forming an image on the sheet 21.

The sheet 21 after transfer is separated from the photoconductive drum 3 by the separatation claw 9 and is then transported to a fixing unit 22 for receiving fixing process on the image formed by the transfer. Thereafter, the sheet 21 is discharged onto a discharge tray 23 outside the body of the machine.

The toner remaining on the surface of the photoconductive drum 3 after transfer is cleaned by the cleaning device 10, and the residual charge is removed by the eraser lamp 11 to get ready for next round of image forming process by charging and exposure.

The sheets 21 are cut in a predetermined size and are accommodated in a sheet cassette 24 which is placed at a paper feed section 25 provided at the lower side of the photoconductive drum 3. In the paper feed section 25, the sheets 21 accommodated in the cassette 24 are fed one by one by a paper feed roller 26 which is rotatively driven and then transported by a register roller 27 simultaneously with a timing of a visualized image on the photoconductive drum 3 to be ready for the transfer process. In this embodiment, it is designed to simultaneously produce a two-color image which forms partially in two different colors by interchangeably using the color developing unit 6 and the black developing unit 7 in one round of image forming process.

Figure 3:
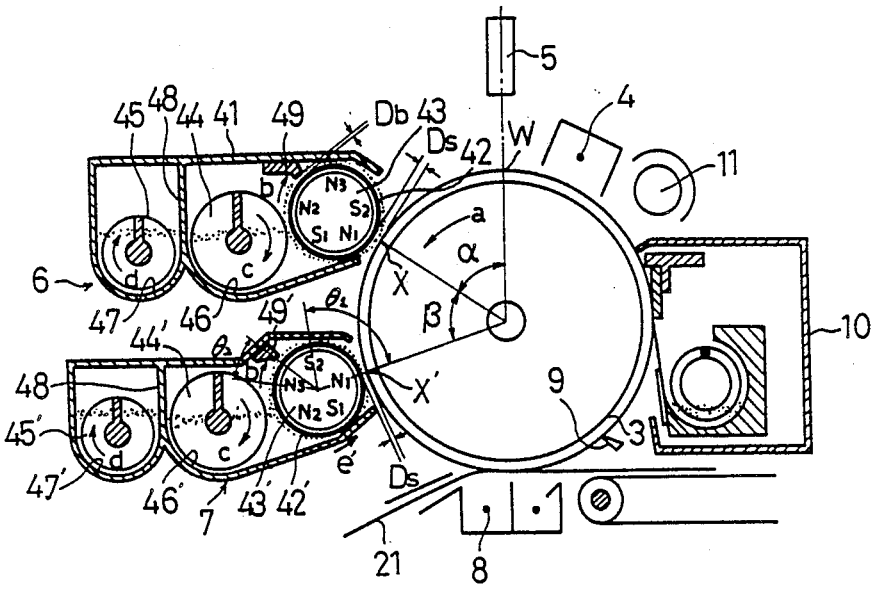
FIG. 3 is an expanded sectional view illustrating the surroundings of a photoconductor provided with the developing unit in FIG. 1.

The structure of the developing units 6,7 will now be described. As illustrated in FIG. 3, both the color developing unit 6 and the black developing unit 7 are constructed in almost the same structure.

In a developer tank 41, a developing sleeve 42, a feed roller 44 and screw 45 are sequentially disposed from the side of the photoconductive drum 3. In the color developing unit 6, a developer composed of magnetic carrier and insulating color toner is accommodated, and in the black developing unit 7, a developer composed of magnetic carrier and insulating black toner which is generally used is accommodated.

The developing sleeve 42 is made of a non-magnetic conductive member cylindrically shaped ($\phi$24.5 mm) and its circumference is unevenly formed by sandblast treatment. The sleeves 42,42' face with the photoconductive drum 3 at the position of developing areas X,X' with a gap: Ds(=0.6 mm), and the angle of rotation of the photoconductive drum 3 from exposure point W to the developing areas X and X' are predetermined as $\alpha$ and $\alpha+\beta$ respectively, wherein $\alpha$ is 56° and $\beta$52°.

At the back of the developing area X of the developing sleeve 42, a height regulating member 49 disposed on the upper inside of the developer tank 41 faces the sleeve with a height regulating gap: Db(=0.4 mm).

Inside the developing sleeve 42, a magnet roller 43 in which a plurality of magnets is are extendedly provided in the axial direction is arranged, and the magnetic force of the magnetic poles ($N_1-N_3$, $S_1$, $S_2$) positioned at the circumference of the magnets are predetermined as; $N_1=1000G$, $N_2,N_3=500G$ and $S_1,S_2=800G$ respectively, wherein G represents gauss.

The center of the magnetic pole $N_1$ is set at the position moved by $\theta_1$ (80°) from the center of the magnetic pole $S_2$ in the clockwise direction as shown in the black developing unit 7, and the magnetic pole $N_3$ is set at the position moved by $\theta_2$ (40°) from the point facing the height regulating member 49 in the counterclockwise direction.

Figure 4:
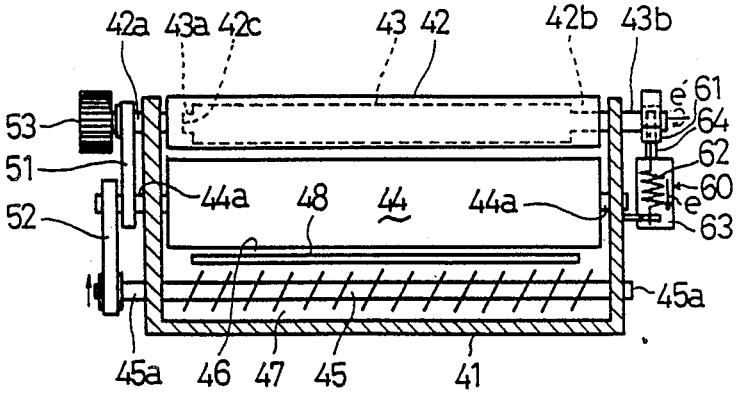
FIG. 4 is a longitudinal sectional view of a developing unit.

One end 43*a* of a shaft of the magnet roller 43 is supported at the bearing convex portion 42*c* provided inside the developing sleeve 42 as shown in FIG. 4 and another end 43*b* of the shaft is supported by the side walls of the developer tank 41 to be movable at a predetermined angle ($\theta_1=40°$) by a shifting means 60 which will be described below.

Figure 5:
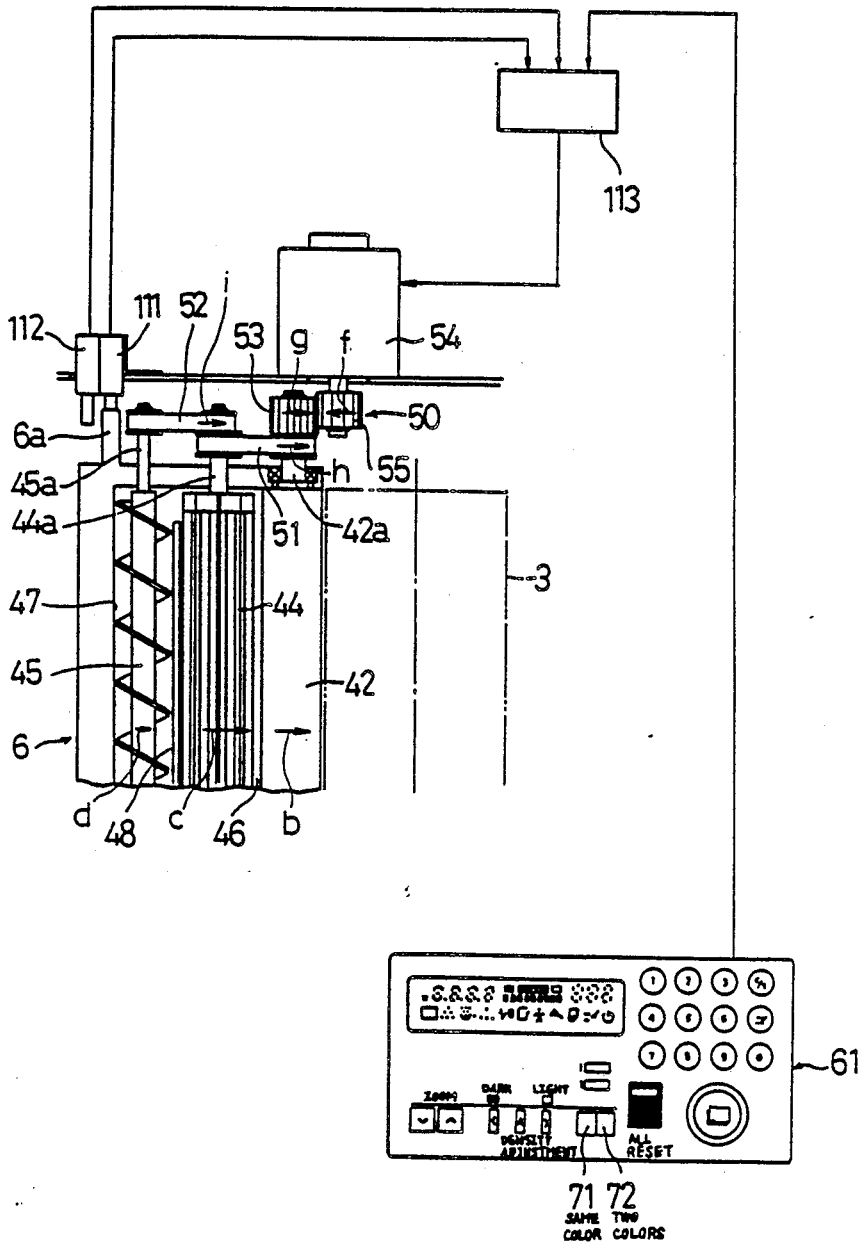
FIG. 5 is a transverse plan view illustrating how a color developing unit and a driving motor are connected under an ordinary state of a copying machine.

A bearing portion 42*b* at the right side in FIG. 4 of the developing sleeve 42 is supported by a shaft 43*b* of the magnet roller 43, and a shaft 42*a* at the opposite side is supported by the side walls of the developer tank 41 to be rotatively driven by a driving means 50 (FIG. 5).

A feed roller 44 and a screw 45 are disposed on the transport paths 46 and 47 partitioned by a partition 48, and their shafts 44*a* and 45*a* are supported by the side walls of the developer tank 41 to be rotatively driven by a driving means 50 (FIG. 5). The transport paths 46 and 47 are connected at both sides of the developer tank 41 as shown in FIG. 4.

The driving means 50 of the developing sleeve 42, the feed roller 44 and the screw 45 will now be described.

As illustrated in FIG. 4, the shaft 42*a* of the developing sleeve 42 and the shaft 44*a* of the feed roller are tied with a belt 51, and the shaft 44*a* of the feed roller 44 and the shaft 45*a* of the screw 45 are tied with a belt 52. At the end of the shaft 42*a* of the developing sleeve 42, a gear 53 is attached which is engaged with a driving gear 55 of a motor 54 as illustrated in FIG. 5. Thus, once the driving gear 55 is rotated by the motor 54 in the direction of arrow f shown in FIG. 5, the gear 53 and the belts 51,52 are moved in the directions of arrow g,h and i respectively, and the developing sleeve 42, the feed roller 44 and the screw 45 are consequently rotated in the directions of arrow b,c and d respectively. The developing sleeve 42 is arranged to rotate at 240 rpm.

As shown in FIG. 4, the shifting means 60 of the magnet roller 43 comprises a lever 61, a spring 62 and a solenoid 63, and the lever 61 is fixed to the end of the shaft 43*b* of the magnet roller 43, and the end of the lever 61 is attached to the spring 62 fixed on a developer tank 41 and always biased in the direction of arrow e. At the other end of the lever 61, a plunger 64 of the solenoid 63 is hooked thereto and is arranged to rotate the lever 61 against the energized force of the spring 62 in the direction of arrow e' when the solenoid is driven. Thus, when the solenoid 63 is not in action, as shown by the black developing unit 7 in FIG. 3, the magnetic pole $N_1$ of the magnet roller 43' faces the photoconductive drum 3 thereby making a developing area thereat while the magnetic pole $N_3$ is moved by $\theta_2$ (40°) in the counterclockwise direction from the position faced with the height regulating member 49'.

Conversely, when the solenoid 63 is put in action and the lever 61 is at the state shown in FIG. 4, the middle part between the magnetic pole $N_3$ and $N_2$ faces the height regulating member 49 as shown by the color developing unit 6 in FIG. 3, while the middle part between the magnetic pole $N_1$ and $S_1$ faces the photoconductive drum 3 thus making the area undevelopable.

Figure 7:
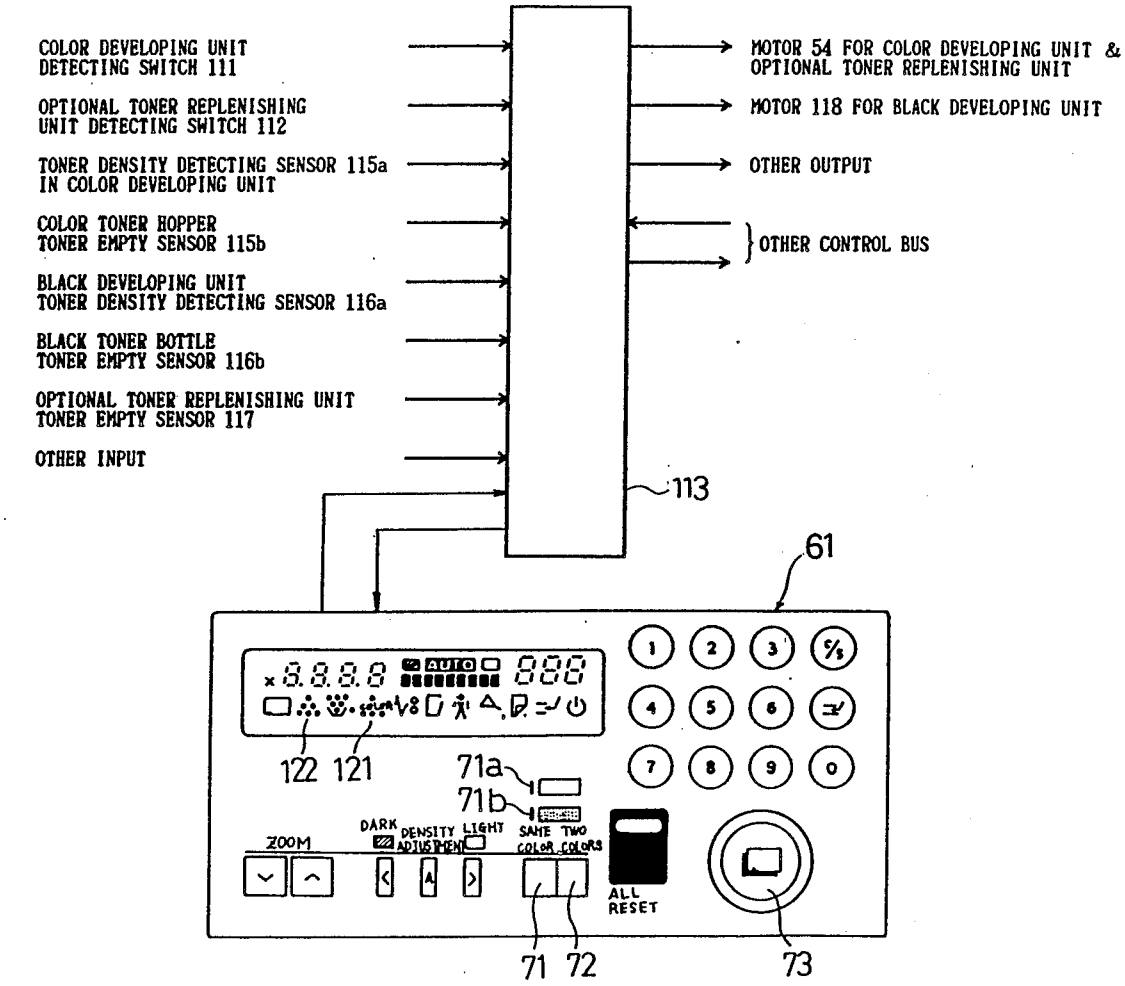
FIG. 7 is a control circuit diagram of a copying machine.

By selectively using the two developing units 6 and 7, black development, color development or simultaneous two color development can be carried out. In order to carry out such selective development, a color designating key 71 and a simultaneous two color designating key 72 are provided on an operation panel 61 as shown in FIGS. 5 and 7.

When the color designating key 71 is operated under the black development state (OFF state), it is changed over to a color development (ON state), and returns to black development (OFF state) when the key is operated once again. Either one of the black development display section 71*a* or the color development display section 71*b* is lit corresponding to the state of development selected.

When the simultaneous two color designating key 72 is operated, it is changed over to a simultaneous two color development, and returns to the state of development set by the selecting key 71 when the key is operated once again. Both display sections 71*a* and 71*b* are lit only when the simultaneous two color development is being set. The reference numeral 73 designates a copy start key.

Figure 2:
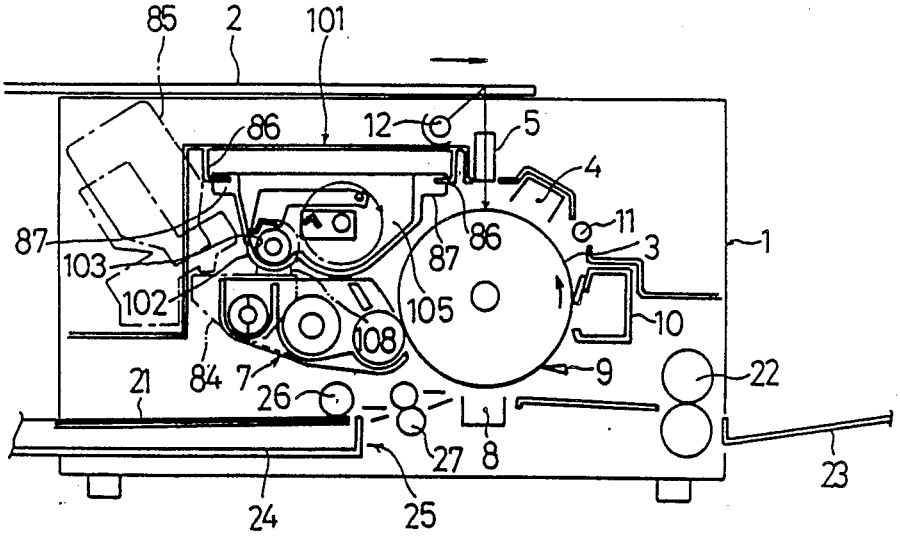
FIG. 2 is a cross-sectional view illustrating a toner replenishing device of the copying machine in FIG. 1 which is being interchangeably used with one of a plurality of developing units.
Figure 8:
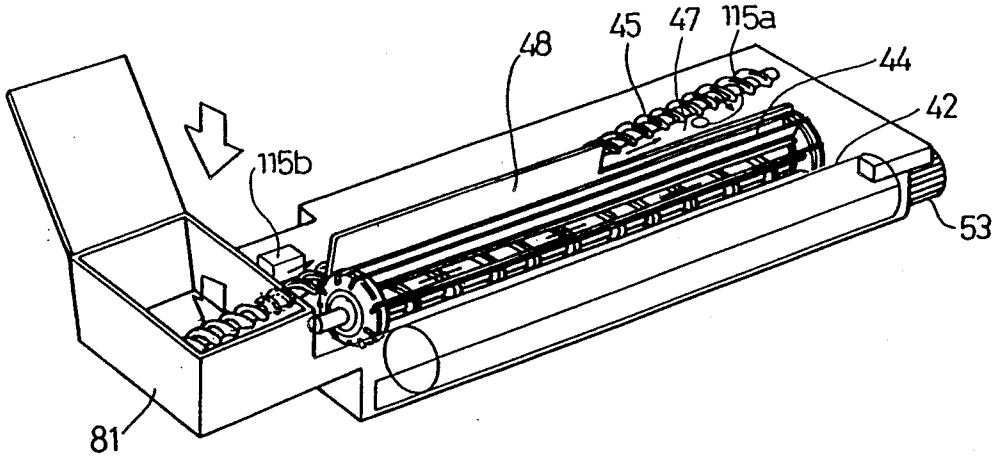
FIG. 8 is a perspective view of a color developing unit.

The color developing unit 6 is provided with a box-type hopper 81 as shown by a phantom line in FIG. 2 and solid line in FIG. 8. The colored toner accommodated in the hopper 81 is fed to a transport path 47 by the screw 45 for developing process.

Figure 9:
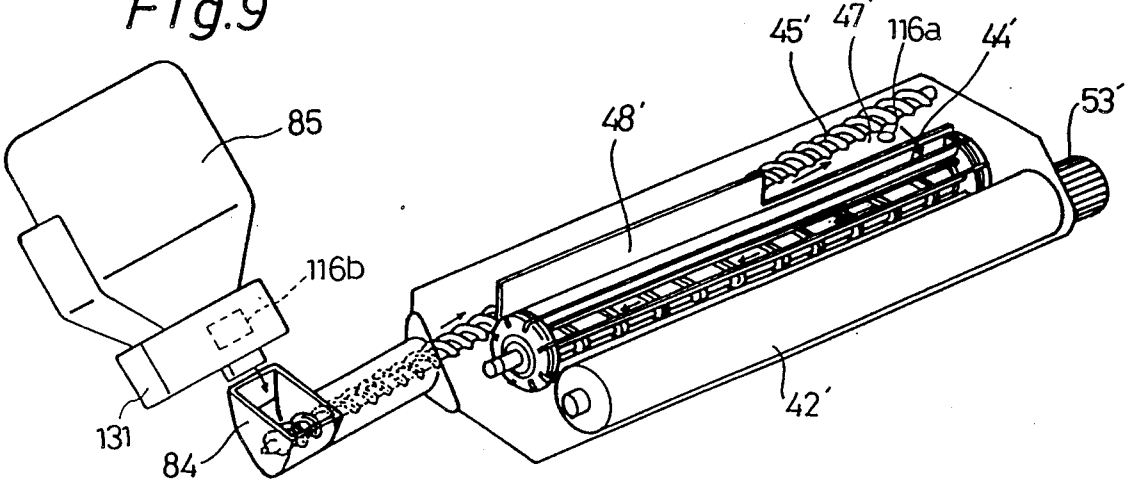
FIG. 9 is a perspective view of a black developing unit.

The black developing unit 7 is provided with a toner hopper 84 as illustrated by phantom lines in FIGS. 1 and 2 and a solid line in FIG. 9, to which black toner is replenished from a black toner bottle 85. The toner replenished to the hopper 84 is fed to a transport path 47' by a screw 45' for developing process.

The black developing unit 7 is very frequently used as compared with the color developing unit 6. However, the color developing unit 6 occupies almost the same space as that of the black developing unit 7 though it is not used much. Accordingly, the present invention is designed to install an optional toner replenishing device 101 in place of the color developing unit 6 as shown in FIG. 2 which is made in almost the same size as that of the color developing unit 6. Accordingly, even if the black developing unit 7 is very frequently used, black toner can be replenished to the black developing unit 7 from this toner replenishing device 101 in addition to a black toner bottle 85 by which the interval for toner replenishment can be extended. The color developing unit 6 is, therefore, attachably and detachably supported by a guide rail 86 as shown in FIG. 2.

The optional toner replenishing device 101 is also arranged to be attachably and detachably supported by the guide rail 86 as illustrated in FIG. 1. Accordingly, the developing unit 6 and the toner replenishing device 101 are provided with a fitting section 87 which is supported by the guide rail 86 for mutual interchangeability. In order to provide interchangeability between the color developing unit 6 and the toner replenishing device 101, the size and shape of the toner replenishing device 101 should be arranged to be equal to or smaller than that of the color developing unit 6 since there is not sufficient space provided around the color developing unit 6. In this embodiment, the size and shape of the toner replenishing device 101 is arranged to be almost the same as that of the color developing unit 6.

Figure 6:
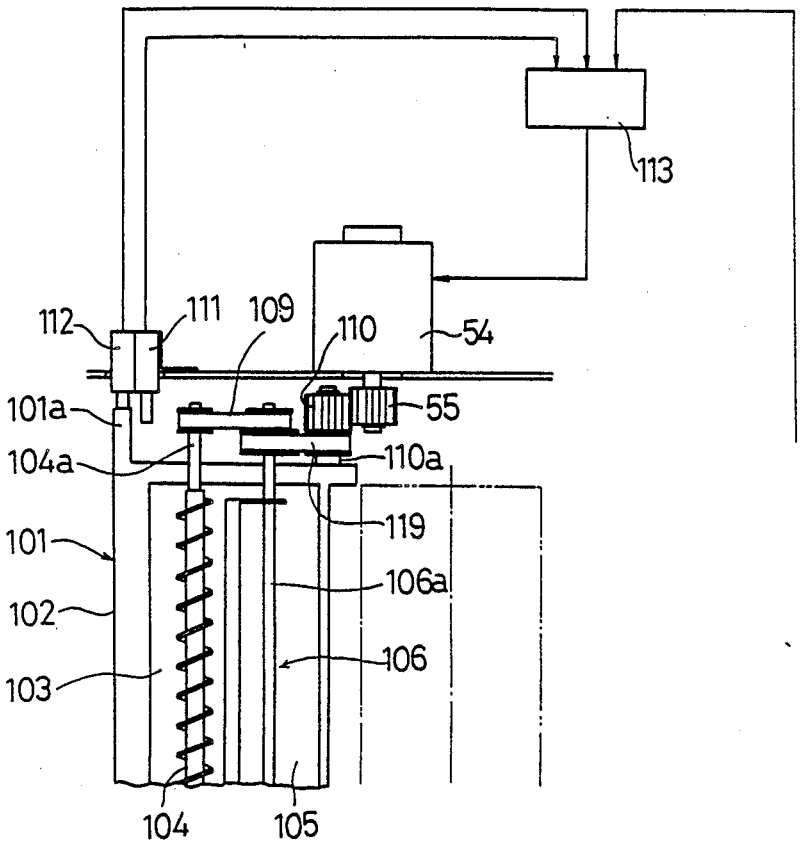
FIG. 6 is a transverse cross section illustrating how a toner replenishing device of a copying machine is being used interchangeably.
Figure 10:
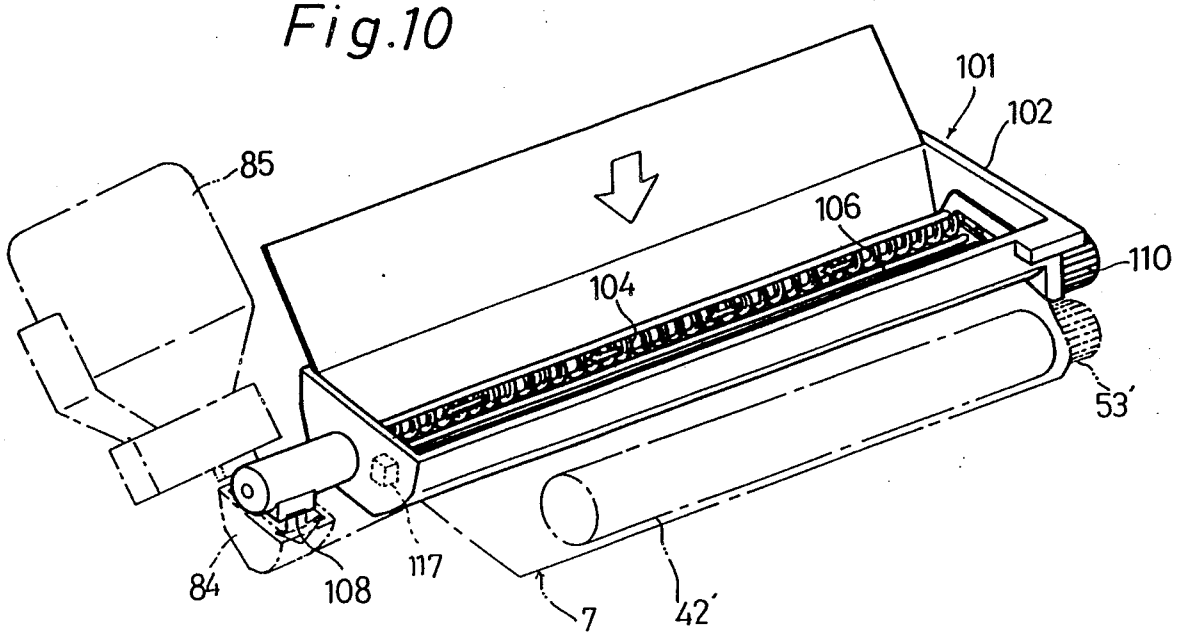
FIG. 10 is a perspective view of a toner replenishing device which is interchangeably used with a developing unit.

The toner replenishing device 101 is provided as illustrated in FIGS. 1, 6 and 10 with a toner transport path 103 at the bottom of a housing 102 along which a screw 104 is arranged for transporting toner from the rear to the front side in FIG. 1. At the side of the toner transport path 103, a toner storage section 105 is provided, and the toner stored therein is scooped up and sprinkled to replenish the toner to the transport path 103. At the front side of the toner transport path 103, a toner replenishing outlet 108 is provided for replenishing toner to a hopper 84 of the black developing unit 7 as shown in FIG. 10.

A shaft 104*a* of the screw 104 is tied to a shaft 106*a* of a toner stirring device 106 with a belt 109 and the shaft 106*a* of the stirring device 106 is tied to a shaft 110*a* of a gear 110 with a belt 119.

The position of the gear 110 of the toner replenishing device 101 when the device 101 is mounted on a copying machine is arranged to be the same as the position of gear 53 of the color developing unit 6 when the color developing unit 6 is mounted on the copying machine. Accordingly, when the toner replenishing device 101 is mounted in place of the color developing unit 6, the gear 110 is interlocked with driving gear 55 of a motor 54. Thus, the toner replenishing device 101 and the color developing unit 6 are arranged to be driven by the motor 54 when either one of them is mounted. The driving timing of the color developing unit 6 is completely different from that of the toner replenishing device 101, and therefore, the driving control is interchangeably applied when the color developing unit 6 is mounted and the toner replenishing device 101 is mounted since they are arranged to be driven with the same motor 54.

In this embodiment, two switches 111 and 112 are provided for detection when the color developing unit 6 or the toner replenishing device 101 is mounted so that the motor 54 is interchangeably driven in accordance with a detecting signal of either one of the switches 111 and 112. The switches 111 and 112 as well as the motor 54 and the operation panel 61 are, therefore, connected to a microcomputer 113 provided for controlling the action of the copying machine.

The color developing unit 6 is provided with a protrusion 6*a* positioned opposite to the switch 111 which is arranged for detecting the color developing unit 6. When the color developing unit 6 is mounted, the protrusion 6*a* pushes the switch 111 which consequently gives a signal to the microcomputer 113 that the color developing unit has been detected, and thereafter, the motor 54 is controlled for driving the color developing unit 6.

The toner replenishing device 101 is provided with a protrusion 101*a* positioned opposite to the switch 112 which is arranged for detecting the toner replenishing device 101. When the toner replenishing device 101 is mounted, the protrusion 101*a* pushes the switch 112 which consequently gives a signal to the microcomputer 113 that the toner replenishing device 101 has been detected, and thereafter, the motor 54 is controlled for driving the toner replenishing device 101.

In the microcomputer 113, as shown in FIG. 7, a toner empty sensor 115*b* of the color toner hopper 81, a toner density detecting sensor 115*a* of the color developing unit 6, an empty sensor 116*b* of the black toner bottle 85, a toner density detecting sensor 116*a* of the black developing unit 7, a toner empty sensor 117 of the optional toner replenishing device 101 and other inputs are connected to each imput port while a driving motor 118 of the black developing unit 7 and other outputs are connected to each output port. Another control bus is also connected to the microcomputer.

The toner density detecting sensors 115a and 116a are, as illustrated in FIGS. 8 and 9, disposed upwardly on the bottom of the transport paths 47,47' and the density of toner is magnetically detected according to the ratio of magnetic carrier included in the toner.

Toner empty sensors 115b, 116b and 117 comprise a combination of a luminous element and a light receiving element.

The sensor 115b is disposed at the inlet section of the transport path 47 facing the screw 45 as shown in FIG. 8. Accordingly, when the volume of toner transported by the screw 45 into the transport path 47 from the hopper 81 is lowered, the reflected light amount from the screw 45 to increases, and it is judged that the toner is emptied when the light being received exceeds a predetermined amount of light.

The sensor 116b is disposed inside the bottle supporting section 131 to which the black toner bottle is equipped as illustrated in FIG. 9. Accordingly, the sensor 116b detects the decrease in the amount of toner being transported from the black toner bottle 85 to the hopper 84 through the supporting section 131 by increase of the reflected light amount and judges the toner emptiness.

The sensor 117 is provided inside the housing 102 of the optional toner replenishing device 101 as shown in FIG. 10, and detects the decrease of toner therein by increase of the reflected light amount and judges the toner emptiness.

The operational control of a developing unit except the case of simultaneous two color development will now be described in accordance with the flow charts in FIGS. 11$_{-1}$ through 11$_{-3}$.

Figures 1, 11:
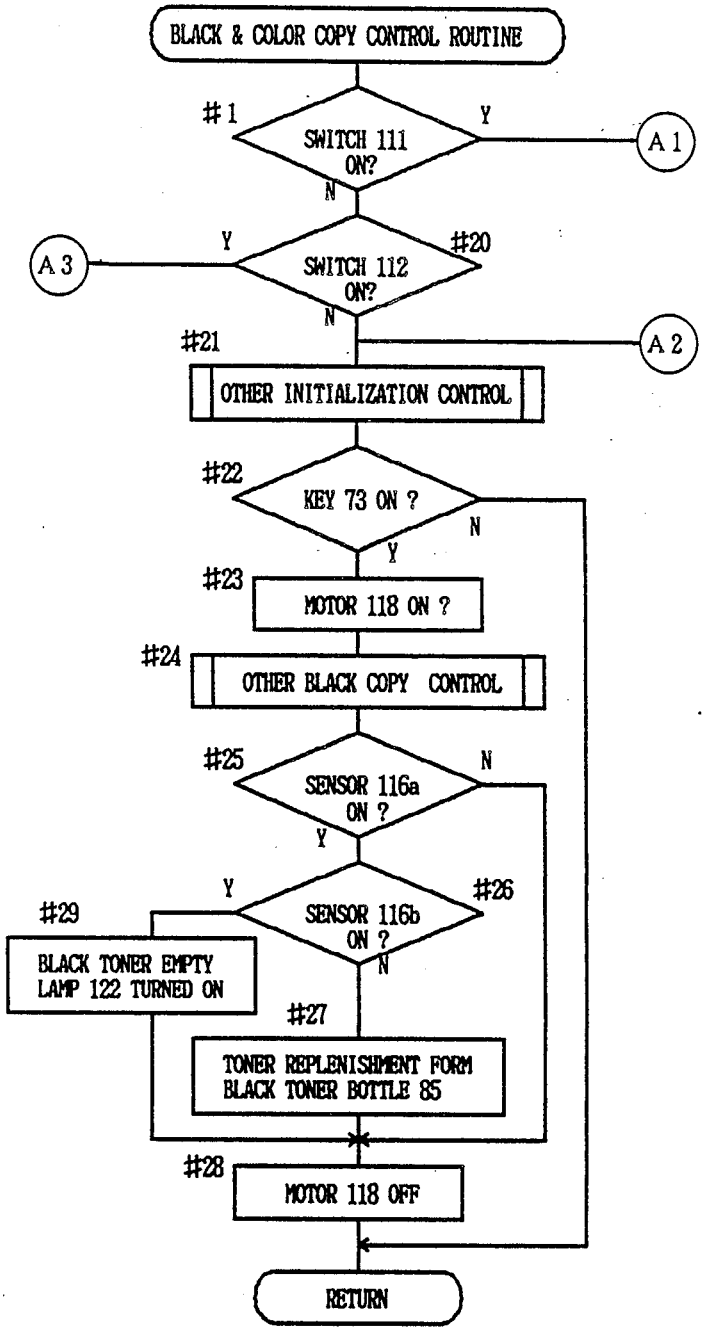
Figures 2, 11:
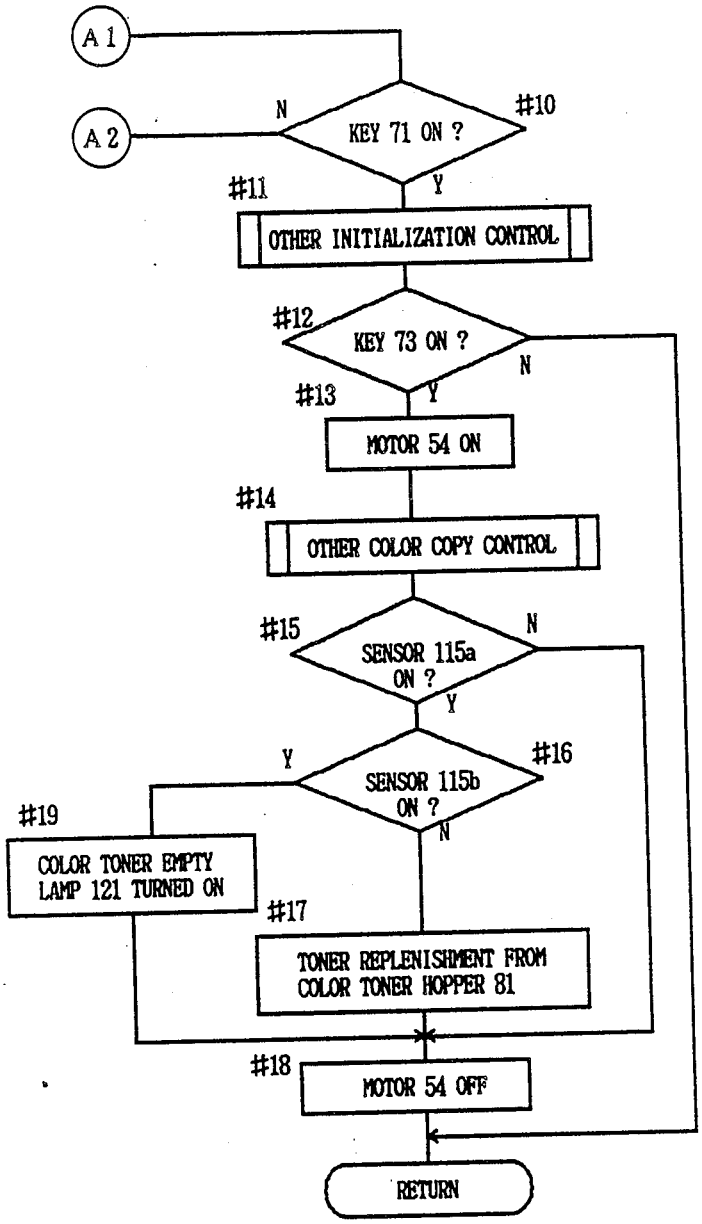
Figures 3, 11:
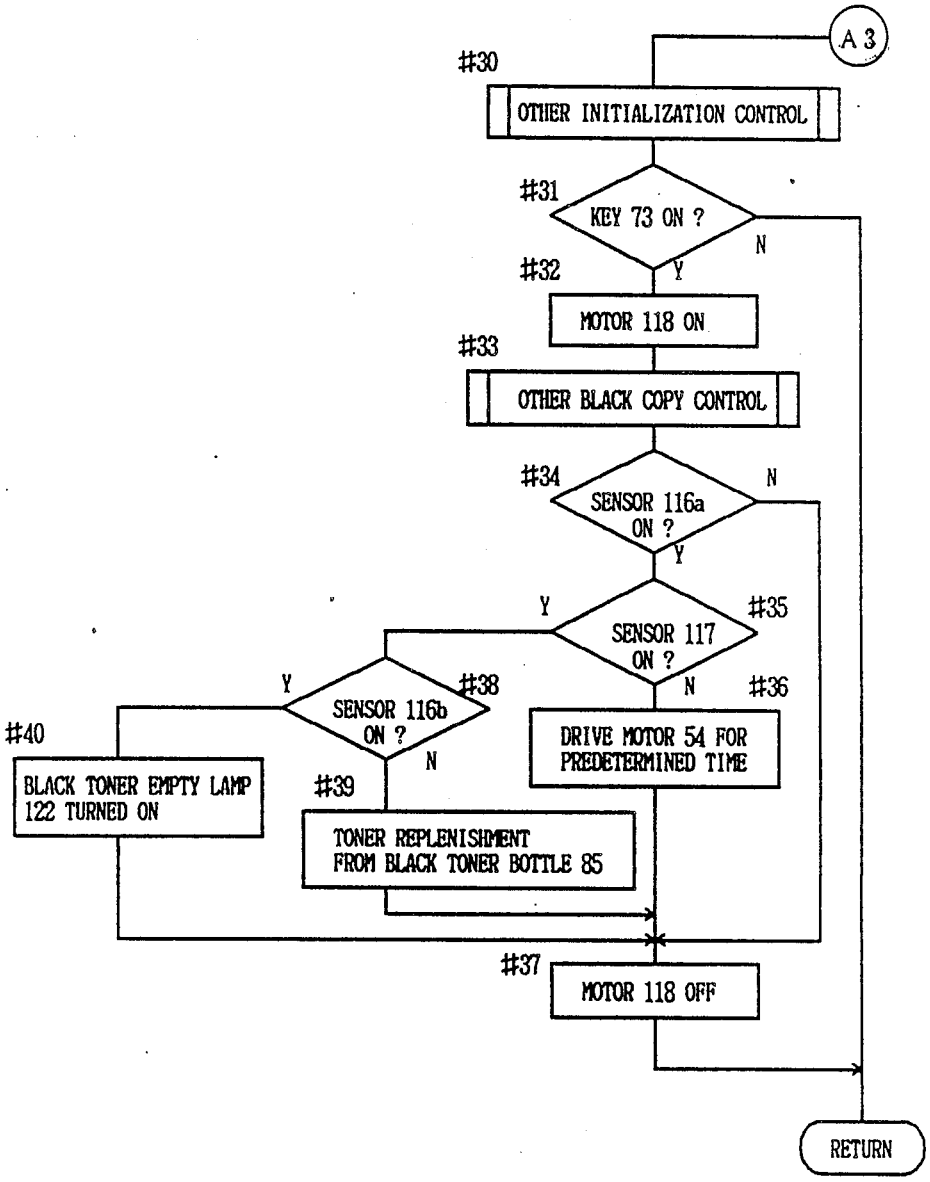

At step #1 in FIG. 11$_{-1}$, judgment is made whether the detection switch 111 is ON or not, and if it is judged ON, the program moves to step #10 in FIG. 11$_{-2}$ and makes judgment whether the color key 71 is ON or not. If the judgment is ON, the program proceeds to color copying control after step #11. At step #11, other initialization control for color development is made, and then judgment is made whether copy start key 73 is turned on or not at step #12. If the key is not turned on, the program is returned, and if it is turned on, the motor 54 to which the developing unit 6 is connected is turned on at step #13. Accordingly, in the color developing unit 6, color toner is transported and supplied to the developing sleeve 42 to be ready for color development. Then, at step #14, other color copying control is carried out to obtain a color copy.

At step #15, judgment is made whether the toner density detecting sensor 115a in the color developing unit 6 is ON or not, i.e., whether toner is in short supply or not, and if it is not ON, the program moves to step #18 while if it is ON, the program proceeds to step #16 and judgment is made whether the toner empty sensor 115b of the color toner hopper 81 is ON or not. If it is not ON, toner is replenished to the color developing unit 6 from the color toner hopper 81 at step #17 and the program moves to step #18. If the toner empty sensor 115b is also ON, a color toner empty lamp 121 (FIG. 7) is turned on at step #19, and then the program moves to step #18. At step #18, the motor 54 is turned off, and transport and supply of color toner is suspended to wait for the next operation.

At step #1 in FIG. 11$_{-1}$, if the detecting switch 111 of the color toner developing unit 6 is not ON, it is specified that the process is under black development, and the program moves to the step #20 and the following procedure in FIG. 11$_{-1}$.

At step #20, judgment is made whether the detecting switch 112 of the optional toner replenishing device 101 is turned on or not. If it is not ON, the program moves to step #21 and the following procedure for control of black copying without the optional toner replenishing device 101. The same procedure is applied to the case when the color designating key 71 is turned off at step #10, and the program proceeds to step #21.

At step #21, other initialization control is carried out for black copying without optional toner replenishing device 101, and judgment is made whether a copy start key 73 is 0N or not at step #22. If it is not ON, the program is returned, and if it is ON, the program proceeds to step #23 and the motor 118 connected to the black developing unit 7 is turned on. Accordingly, in the black developing unit 7, black toner is transported and supplied to the developing sleeve 42a to be ready for black development. Then, at the next step #24, other black copying control is carried out to obtain a black copy.

At step #25, judgment is made whether a toner density detecting sensor 116a in the black developing unit 7 is turned on or not, and if it is not ON, the program moves to step #28. If it is judged as ON, judgment is further made whether an empty sensor 116b of the black bottle 85 is ON or not at step #26, and if it is not ON, black toner is replenished to the black developing unit 7 from the black toner bottle 85 and the program moves to step #28. If the sensor 116b is ON at step #26, the program moves to step #29 and the black toner empty lamp 122 (FIG. 7) is turned on, and then the program proceeds to step #28. At step #28, the motor 118 is turned off, and transport and supply of black toner is suspended to wait for next operation.

If the detecting switch 112 of the optional toner replenishing device 101 is ON at step #20 in FIG. 11$_{-1}$, the program moves to step #30 and the following steps in FIG. 11$_{-3}$ for control of black copying with the optional toner replenishing device 101.

At step #30, other initialization control is carried out, and judgment is made whether copy start key 73 is turned on or not at step #31. If it is not turned on, the program is returned, and if it is turned on, the program proceeds to step #32 and the motor 118 is turned on. Thus, in the black developing unit 7, black development becomes ready to be carried out. At the next step #33, other black copying control is carried out to obtain a black copy.

Then, at step #34, judgment is made whether the toner density detecting sensor 116a in the black developing unit 7 is ON or not at step #34, and if it is not ON, the program moves to step #37. If it is ON, judgment is made whether the empty sensor 117 of the optional toner replenishing device 101 is ON or not at step #35, and if it is not ON, the motor 54 is driven for a predetermined period of time at step #36 and a predetermined volume of black toner is replenished to the black toner developing unit 7 from the toner replenishing device 101. Thereafter, the program proceeds to step #37.

If the sensor 117 is ON at step #35, the program moves to step #38, and judgment is made whether the empty sensor 116b of the black toner bottle 85 is ON or not. If it is not ON, black toner is replenished to the black developing unit 7 from the black toner bottle 85, then the program proceeds to step #37. If the sensor 116*b* is ON at step #38, the program moves to step #40 and a black toner empty lamp 122 is turned on, then the program proceeds to step #37. At step #37, the motor 118 is turned off, and transport and supply of black toner is suspended to wait for next operation.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus, comprising:
a rotatable photoconductor;
means for forming an electrostatic latent image on the photoconductor;
a plurality of developing means provided along a direction of movement of the photoconductor with each one of the developing means being selectively operable to develop the electrostatic latent image formed on the photoconductor; and
a toner replenishing means for replenishing toner into one of the plurality of developing means, the toner replenishing means being mountable in the image forming apparatus in place of one of the developing means.

2. The image forming apparatus as claimed in claim 1, wherein the toner replenishing means is attachable to a position occupied by any one of the plurality of developing units except the one placed undermost in the direction of movement of the photoconductor.

3. The image forming apparatus as claimed in claim 2, wherein the developing unit placed undermost is a black toner developing unit and the other developing units are other color toner developing units.

4. The image forming apparatus as claimed in claim 1, wherein the toner replenishing means is provided with a section connectable to a driving means provided for driving a developing unit.

5. The image forming apparatus as claimed in claim 1, wherein the toner replenishing means is about the same size and shape as the developing units.

6. An image forming apparatus, comprising:
a rotatable photoconductor;
means for forming an electrostatic latent image on the photoconductor;
a first developing unit arranged opposite to the photoconductor for developing the electrostatic latent image;
a second developing unit arranged opposite to the photoconductor for developing the electrostatic latent image, the second developing unit being arranged to be attachable to or detachable from the image forming apparatus; and
a hopper provided for replenishing toner to the first developing unit, the hopper being attachable to the position at which the second developing unit is normally attached.

7. The image forming apparatus as claimed in claim 6, wherein the hopper is about the same size and shape as the second developing unit.

8. The image forming apparatus as claimed in claim 6, wherein the hopper is provided with a supply means for supplying toner to the first developing unit and a connecting means when the hopper is attached to the image forming apparatus for connecting the supply means to a driving means arranged for driving the second developing unit.

9. An image forming apparatus, comprising:
a rotatable photoconductor;
means for forming an electrostatic latent image on the photoconductor;
a first developing unit arranged opposite to the photoconductor for developing the electrostatic latent image, said first developing unit having a first hopper for replenishing toner;
a second developing unit arranged opposite to the photoconductor for developing the electrostatic latent image, said second developing unit being arranged to be attachable to or detachable from the image forming apparatus;
a second hopper for replenishing toner to the first developing unit, the second hopper being attachable to the position at which the second developing unit is normally attached;
a detecting means for detecting whether the second hopper is attached; and
a control means for preceding the supply of toner from the second hopper by the supply of toner from the first hopper when the second hopper is attached.

10. The image forming apparatus as claimed in claim 9, further comprising:
a detecting means for detecting whether toner is in the first hopper;
a detecting means for detecting whether toner is in the second hopper; and
a second control means for supplying toner from the second hopper when the first hopper is empty.

11. The image forming apparatus as claimed in claim 6, wherein the first developing unit is a black toner developing unit and the second developing unit is an other color toner developing unit.

12. An image forming apparatus which includes:
a first developing unit and a second developing unit disposed opposite to a photoconductor for developing an electrostatic latent image formed on the photoconductor, said first developing unit being removable therefrom; and
a toner replenishing hopper attachable in place of a removed first developing unit, to occupy substantially the same space occupied by said first developing unit, said toner replenishing hopper having a replenishing outlet for replenishing toner to the second developing unit.

13. The image forming apparatus as claimed in claim 12, wherein said toner replenishing hopper is about the same size and shape as the first developing unit.

14. The image forming apparatus as claimed in claim 13, wherein said toner replenishing hopper includes a section connectable to a driving means arranged to drive the first developing unit in the image forming apparatus.

* * * * *

UNITED STATES PATENT AND TRADEMARK OFFICE

CERTIFICATE OF CORRECTION

PATENT NO. : 4,937,627

DATED : June 26, 1990

INVENTOR(S) : Hiroshi Ozawa, et al.

It is certified that error appears in the above-identified patent and that said Letters Patent is hereby corrected as shown below:

In col. 1, line 15, after "above", delete "," (comma).

In col. 1, line 29, delete "is".

In col. 3, line 55, delete "with".

In col. 3, line 66, delete "are".

In col. 4, line 62, change "faced with" to --facing--.

In col. 6, line 24, delete "a".

In col. 7, line 18, delete "to".

In col. 8, line 4, delete "the" (second occurrence).

In col. 10, line 53 (claim 12, line 8), delete "," (comma).

Signed and Sealed this

First Day of October, 1991

*Attest:*

*Attesting Officer*

HARRY F. MANBECK, JR.

*Commissioner of Patents and Trademarks*